US010801327B2

(12) United States Patent
Song

(10) Patent No.: US 10,801,327 B2
(45) Date of Patent: Oct. 13, 2020

(54) GAS TURBINE ENGINE BLADE AIRFOIL PROFILE

(71) Applicant: United Technologies Corporation, Farmington, CT (US)

(72) Inventor: Kevin K. Song, Vernon, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 89 days.

(21) Appl. No.: 16/252,916

(22) Filed: Jan. 21, 2019

(65) Prior Publication Data

US 2020/0232328 A1 Jul. 23, 2020

(51) Int. Cl.
*F01D 5/14* (2006.01)
*F04D 29/32* (2006.01)

(52) U.S. Cl.
CPC ..... *F01D 5/141* (2013.01); *F04D 29/324* (2013.01); *F05D 2220/32* (2013.01); *F05D 2250/74* (2013.01)

(58) Field of Classification Search
CPC ..... F01D 5/141; F04D 29/324
See application file for complete search history.

(56) References Cited

U.S. PATENT DOCUMENTS 6,779,977 B2 8/2004 Lagrange et al.
8,439,645 B2 5/2013 Tsifourdaris

*Primary Examiner* — Moshe Wilensky
*Assistant Examiner* — Cameron A Corday
(74) *Attorney, Agent, or Firm* — Getz Balich LLC

(57) ABSTRACT

A turbine blade for a gas turbine engine is disclosed. The turbine blade includes an airfoil including leading and trailing edges joined by spaced-apart pressure and suction sides to provide an exterior airfoil surface extending from a platform in a radial direction to a tip. The external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by a local axial chord, and a span location, wherein the local axial chord corresponds to a width of the airfoil between the leading and trailing edges at the span location.

17 Claims, 5 Drawing Sheets

GAS TURBINE ENGINE BLADE AIRFOIL PROFILE

BACKGROUND

1. Technical Field

This disclosure relates to a gas turbine engine, and more particularly to an airfoil that may be incorporated into a gas turbine engine.

2. Background Information

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

In turbine blade design, there is an emphasis on stress-resistant airfoil and platform designs, with reduced losses, increased lift and turning efficiency, and improved turbine performance and service life. To achieve these results, non-linear flow analyses and complex strain modeling are required, making practical results difficult to predict. Blade loading considerations also impose substantial design limitations, which cannot easily be generalized from one system to another.

SUMMARY

According to an embodiment of the present disclosure, a turbine blade for a gas turbine engine is disclosed. The turbine blade includes an airfoil including leading and trailing edges joined by spaced-apart pressure and suction sides to provide an exterior airfoil surface extending from a platform in a radial direction to a tip. The external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by a local axial chord, and a span location, wherein the local axial chord corresponds to a width of the airfoil between the leading and trailing edges at the span location.

In the alternative or additionally thereto, in the foregoing embodiment, the airfoil is a second-stage turbine blade.

In the alternative or additionally thereto, in the foregoing embodiment, the span location corresponds to a distance from a rotational axis of the airfoil.

In the alternative or additionally thereto, in the foregoing embodiment, the Cartesian coordinates in Table 1 have a tolerance relative to the specified coordinates of ±0.050 inches (±1.27 mm).

According to another embodiment of the present disclosure, a gas turbine engine is disclosed. The gas turbine engine includes a high-pressure turbine configured to drive a compressor section. The high-pressure turbine includes an array of turbine blades. At least one turbine blade includes an airfoil having leading and trailing edges joined by spaced-apart pressure and suction sides to provide an exterior airfoil surface extending from a platform in a radial direction to a tip. The external airfoil is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by a local axial chord, and a span location, wherein the local axial chord corresponds to a width of the airfoil between the leading and trailing edges at the span location.

In the alternative or additionally thereto, in the foregoing embodiment, the array is a second-stage array of turbine blades.

In the alternative or additionally thereto, in the foregoing embodiment, the high-pressure turbine includes an array of fixed stator vanes upstream from the second-stage array of turbine blades.

In the alternative or additionally thereto, in the foregoing embodiment, the second-stage array of turbine blades includes forty-four turbine blades.

In the alternative or additionally thereto, in the foregoing embodiment, the span location corresponds to a distance from a rotational axis of the airfoil.

In the alternative or additionally thereto, in the foregoing embodiment, the Cartesian coordinates in Table 1 have a tolerance relative to the specified coordinates of ±0.050 inches (±1.27 mm).

In the alternative or additionally thereto, in the foregoing embodiment, the high-pressure turbine includes two arrays of turbine blades and two arrays of fixed stator vanes.

According to another embodiment of the present disclosure, a gas turbine engine is disclosed. The gas turbine engine includes a compressor section, a combustor in fluid communication with the compressor section, and a turbine section in fluid communication with the combustor. The turbine section includes a high-pressure turbine coupled to the compressor section via a shaft and a low-pressure turbine aft of the high-pressure turbine. The high-pressure turbine includes an array of turbine blades. At least one turbine blade includes an airfoil having leading and trailing edges joined by spaced-apart pressure and suction sides to provide an exterior airfoil surface extending from a platform in a radial direction to a tip. The external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by a local axial chord, and a span location, wherein the local axial chord corresponds to a width of the airfoil between the leading and trailing edges at the span location.

In the alternative or additionally thereto, in the foregoing embodiment, the array is a second-stage array of turbine blades.

In the alternative or additionally thereto, in the foregoing embodiment, the high-pressure turbine includes an array of fixed stator vanes upstream from the second-stage array of turbine blades.

In the alternative or additionally thereto, in the foregoing embodiment, the second-stage array of turbine blades includes forty-four turbine blades.

In the alternative or additionally thereto, in the foregoing embodiment, the span location corresponds to a distance from a rotational axis of the airfoil.

In the alternative or additionally thereto, in the foregoing embodiment, the Cartesian coordinates in Table 1 have a tolerance relative to the specified coordinates of ±0.050 inches (±1.27 mm).

In the alternative or additionally thereto, in the foregoing embodiment, the high-pressure turbine includes two arrays of turbine blades and two arrays of fixed stator vanes.

In the alternative or additionally thereto, in the foregoing embodiment, the low-pressure turbine includes between three and six stages of turbine blades.

In the alternative or additionally thereto, in the foregoing embodiment, the gas turbine engine further includes a fan section including a plurality of fan blades and a geared architecture configured to cause the fan section to rotate at a lower speed than the low-pressure turbine.

The present disclosure, and all its aspects, embodiments and advantages associated therewith will become more readily apparent in view of the detailed description provided below, including the accompanying drawings.

DETAILED DESCRIPTION

Figure 1:
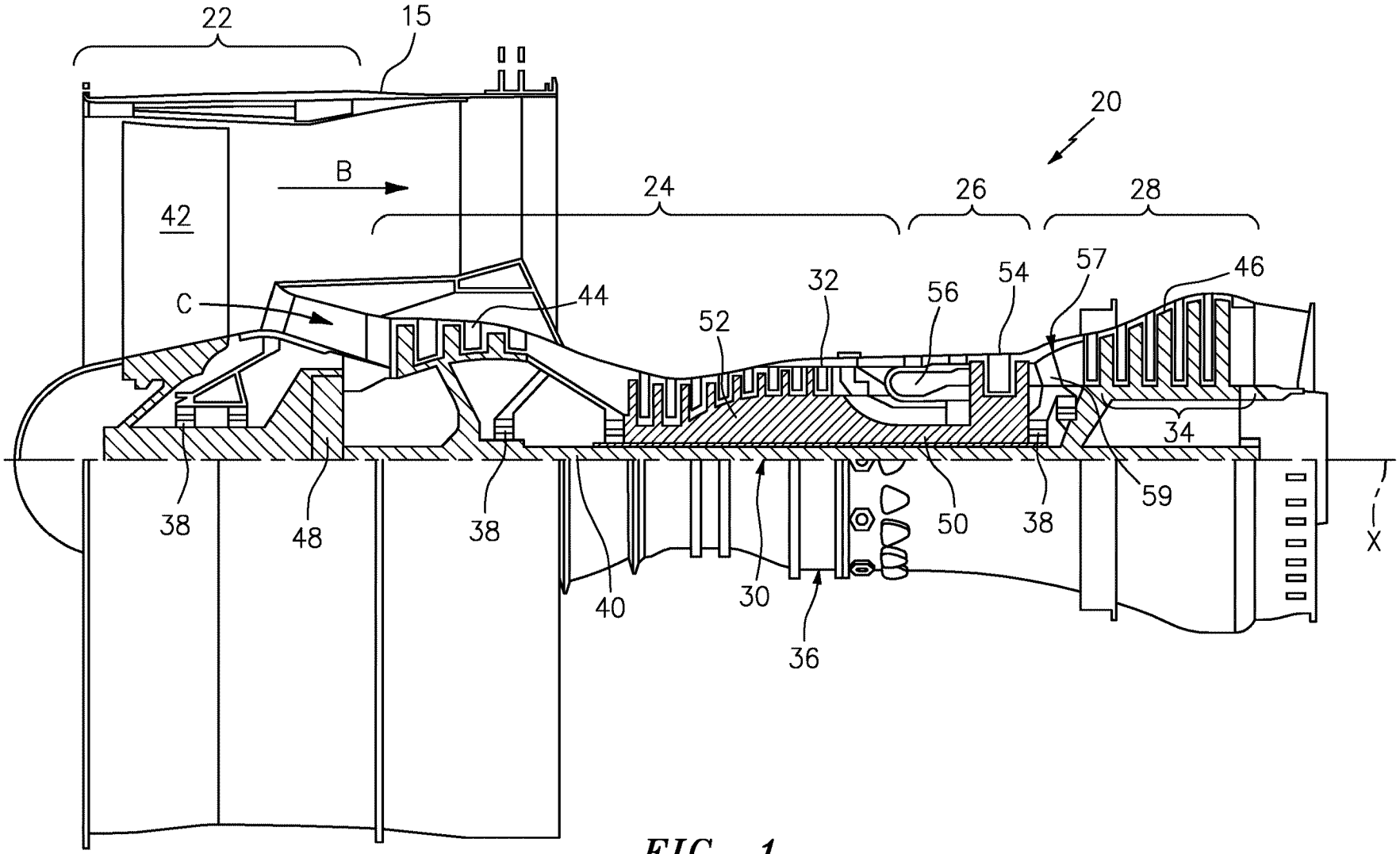
FIG. 1 is a schematic cross-section of a gas turbine engine.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

FIG. 1 schematically illustrates a gas turbine engine 20. The gas turbine engine 20 is disclosed herein as a two-spool turbofan that generally incorporates a fan section 22, a compressor section 24, a combustor section 26, and a turbine section 28. Alternative engines might include other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low-speed spool 30 and a high-speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low-speed spool 30 generally includes an inner shaft 40 that interconnects a fan 42, a first (or low) pressure compressor 44 and a first (or low) pressure turbine 46. The inner shaft 40 is connected to the fan 42 through a speed-change mechanism, which in exemplary gas turbine engine 20 is illustrated as a geared architecture 48 to drive the fan 42 at a lower speed than the low-speed spool 30. The high-speed spool 32 includes an outer shaft 50 that interconnects a second (or high) pressure compressor 52 and a second (or high) pressure turbine 54. In one example, the high-pressure turbine 54 includes at least two stages to provide a double-stage high-pressure turbine 54. In another example, the high-pressure turbine 54 includes only a single stage. As used herein, a "high-pressure" compressor or turbine experiences a higher pressure than a corresponding "low pressure" compressor or turbine. A combustor 56 is arranged in exemplary gas turbine 20 between the high-pressure compressor 52 and the high-pressure turbine 54. A mid-turbine frame 57 of the engine static structure 36 is arranged generally between the high-pressure turbine 54 and the low-pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low-pressure compressor 44 then the high-pressure compressor 52, mixed and burned with fuel in the combustor 56, then expanded over the high-pressure turbine 54 and low-pressure turbine 46. The mid-turbine frame 57 includes airfoils 59 which are in the core airflow path C. The turbines 46, 54 rotationally drive the respective low-speed spool 30 and high-speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

In some embodiments, the fan section 22 includes 26 or fewer fan blades 42, or more narrowly 20 or fewer fan blades 42. In embodiments, the low-pressure turbine 46 may include six or fewer turbine rotors or stages, schematically indicated at 34. In further embodiments, the low-pressure turbine 46 includes between 3 and 6 turbine rotors. In some embodiments, a ratio between the number of fan blades 42 and the number of low-pressure turbine rotors 34 is between about 3.3 and about 8.6. The example low-pressure turbine 46 provides the driving power to rotate the fan section 22 and therefore the relationship between the number of turbine rotors 34 in the low-pressure turbine 46 and the number of blades 42 in the fan section 22 disclose an example gas turbine engine 20 with increased power transfer efficiency.

Figure 2:
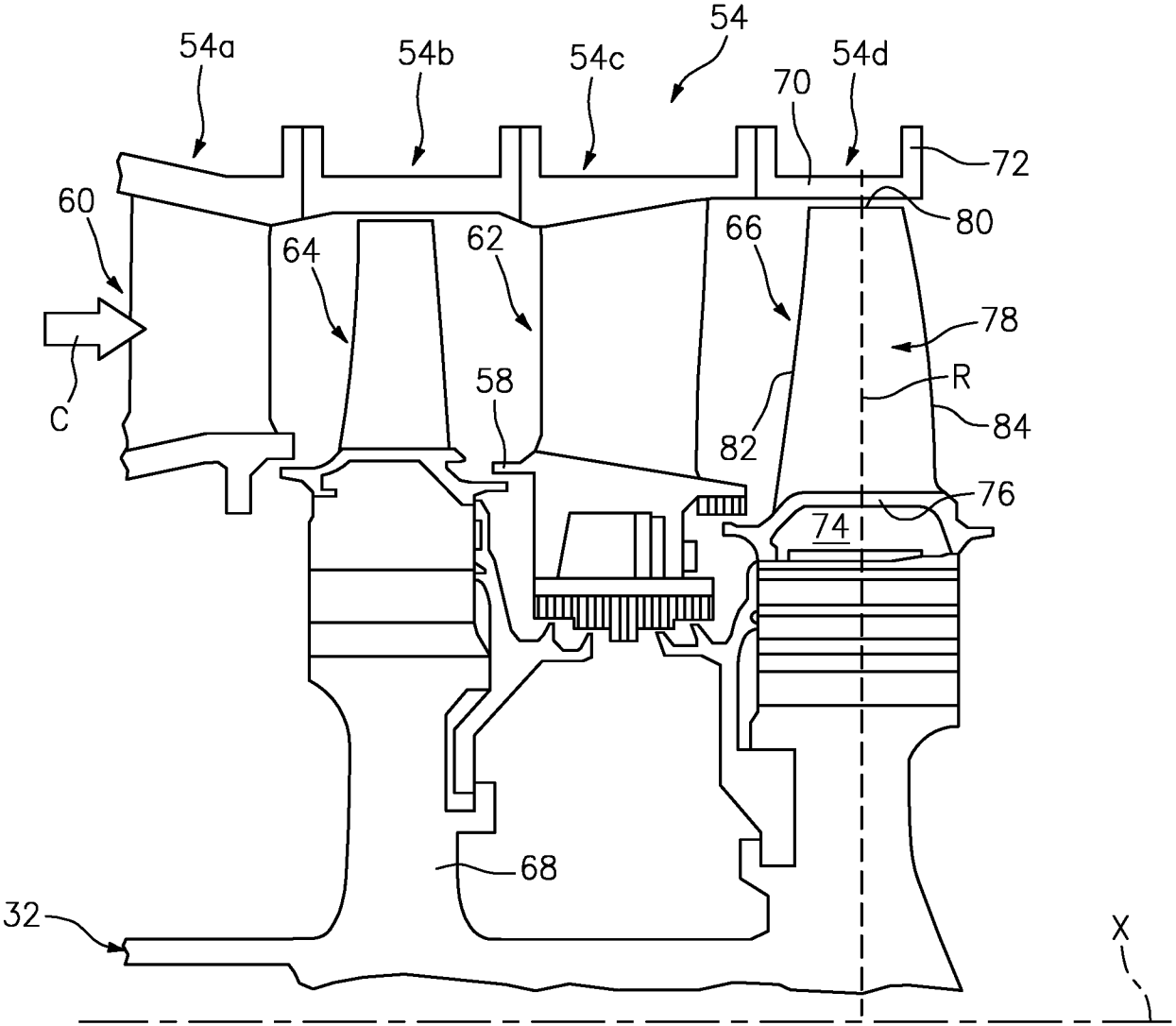
FIG. 2 is a cross-sectional side view of a high-pressure turbine section of a gas turbine engine.

Referring to FIG. 2, a cross-sectional view through a high-pressure turbine 54 section is illustrated. In the example high-pressure turbine 54 section, first and second arrays 54*a*, 54*c* of circumferentially-spaced fixed vanes 60, 62 are axially spaced apart from one another. A first-stage array 54*b* of circumferentially-spaced turbine blades 64 is arranged axially between the first and second fixed-vane arrays 54*a*, 54*c*. A second-stage array 54*d* of circumferentially-spaced turbine blades 66 is arranged aft of the second array 54*c* of fixed vanes 62. The first and second-stage arrays 54*b*, 54*d* are arranged within a core flow path C and are operatively connected to a spool 32.

A root 74 of each turbine blade 66 is mounted to the rotor disk 68. The turbine blade 66 includes a platform 76, which provides the inner flow path, supported by the root 74. An airfoil 78 extends in a radial direction R from the platform 76 to a tip 80. It should be understood that the turbine blades may be integrally formed with the rotor such that the roots 74 are eliminated. In such a configuration, the platform 76 is provided by the outer diameter of the rotor. The airfoil 78 provides leading and trailing edges 82, 84. The tip 80 is arranged adjacent a blade outer air seal 70 mounted to a turbine case 72. A platform 58 of the second fixed-vane array 62 is arranged in an overlapping relationship with the turbine blades 64, 66.

Figure 3A:
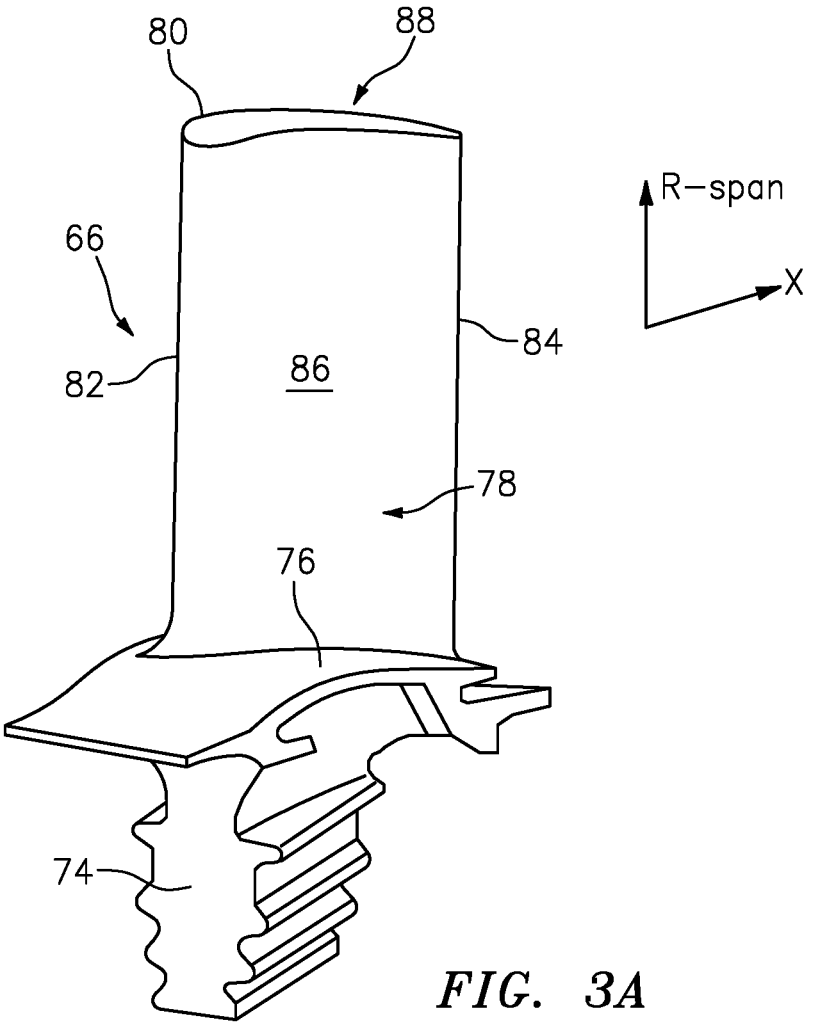
FIG. 3A is a perspective view of a generic airfoil.
Figure 3B:
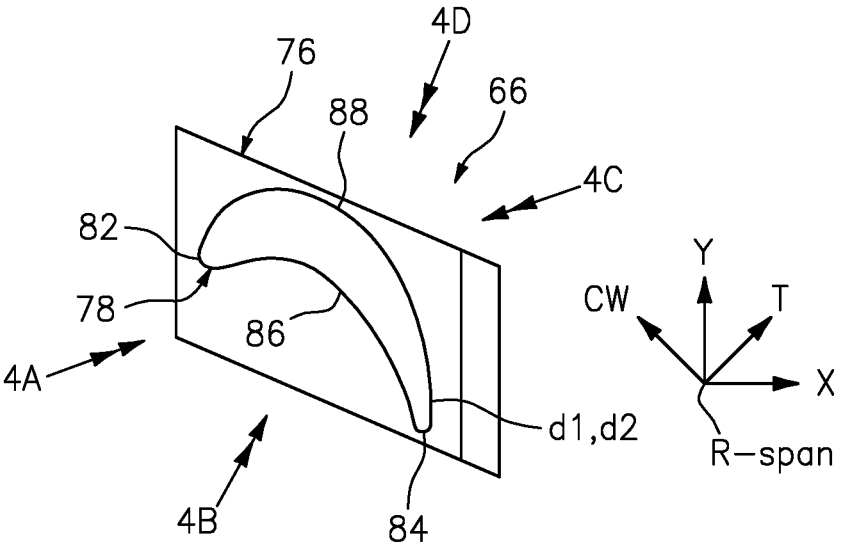
FIG. 3B is a plan, top view of the airfoil of FIG. 3A illustrating directional references.
Figure 4A:
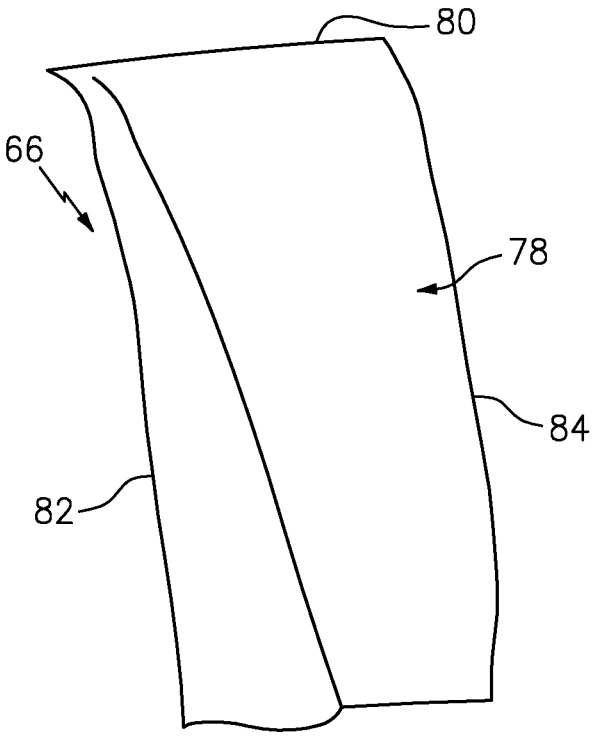
FIGS. 4A-4D are perspective side views of an exemplary airfoil corresponding to the directional references of FIG. 3B.
Figure 4C:
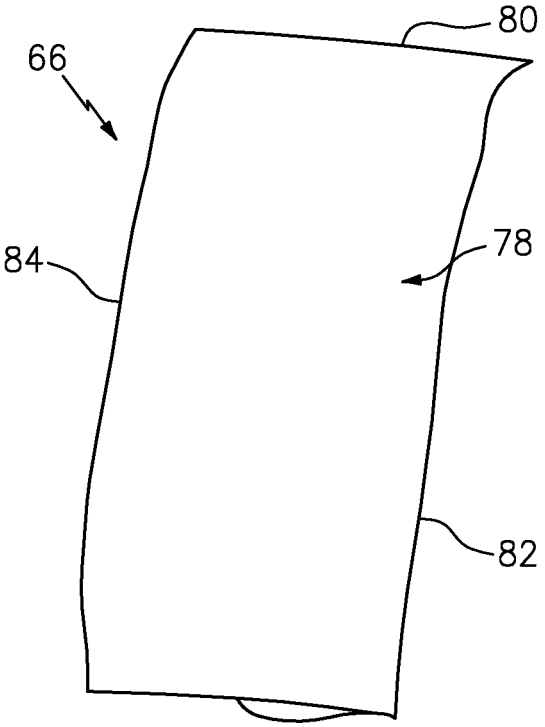
Figure 4B:
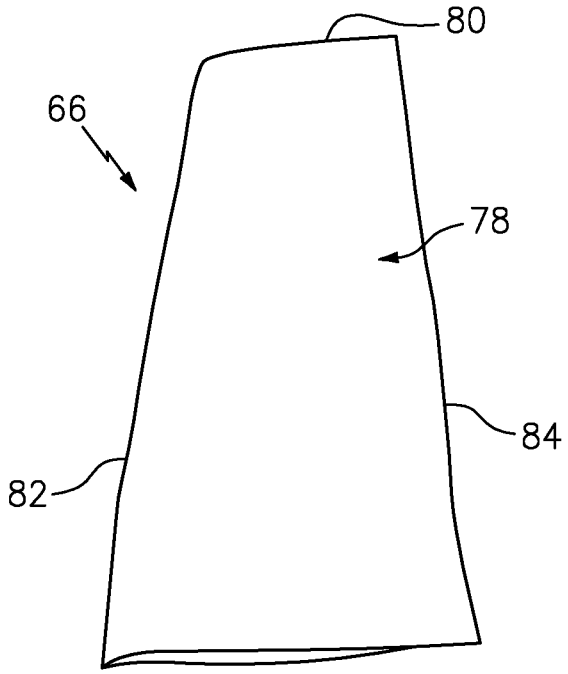
Figure 4D:
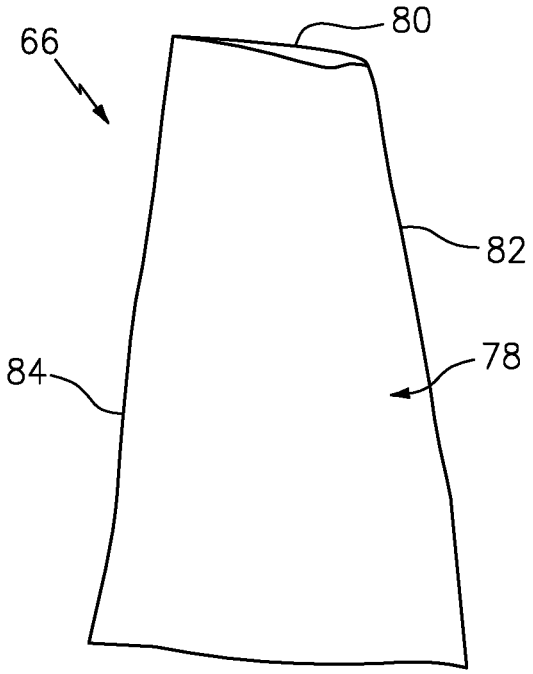

FIGS. 3A and 3B schematically illustrate the airfoil 78 having an exterior airfoil surface extending in a chord-wise direction CW from a leading edge 82 to a trailing edge 84. The airfoil 78 is provided between pressure and suction sides 86, 88 in an airfoil thickness direction T, which is generally perpendicular to the chord-wise direction CW. Multiple turbine blades 66 are arranged circumferentially in a circumferential direction Y. The airfoil 78 extends from the platform 76 and the root 74 in the radial direction R-span, or spanwise, to the tip 80. The exterior airfoil surface may include multiple film cooling holes (not shown). In some embodiments, a ratio of a first radius d1 defining a first contour of the trailing edge 84 at 0% span and a second radius d2 defining a second contour of the trailing edge 84 at 100% span is greater than or equal to about 0.6, or more narrowly greater than or equal to about 0.65. The radii d1, d2 define a radius of curvature of the surface contour of the trailing edge 84 taken generally in the x-y plane. For the purposes of this disclosure, the term about means±3 percent unless otherwise disclosed.

The exterior surface of the airfoil 78 generates lift based upon its geometry and direct flow along the core flow path C. Various views of the airfoil 78 of the turbine blade 66 are shown in FIGS. 4A-4D. In one example, the second-stage array 54*d* consists of forty-four (44) turbine blades 66, but the number may vary according to engine size. The turbine blades 66 can be constructed from a high-strength, heat-resistant material such as a nickel-based or cobalt-based superalloy, or of a high-temperature, stress-resistant ceramic or composite material, for example. In cooled configurations, internal fluid passages and external cooling apertures provide for a combination of impingement and film cooling. In addition, one or more thermal barrier coatings (TBC), abrasion-resistant coatings, and/or other protective coatings may be applied to the turbine blade 66.

Figure 5:
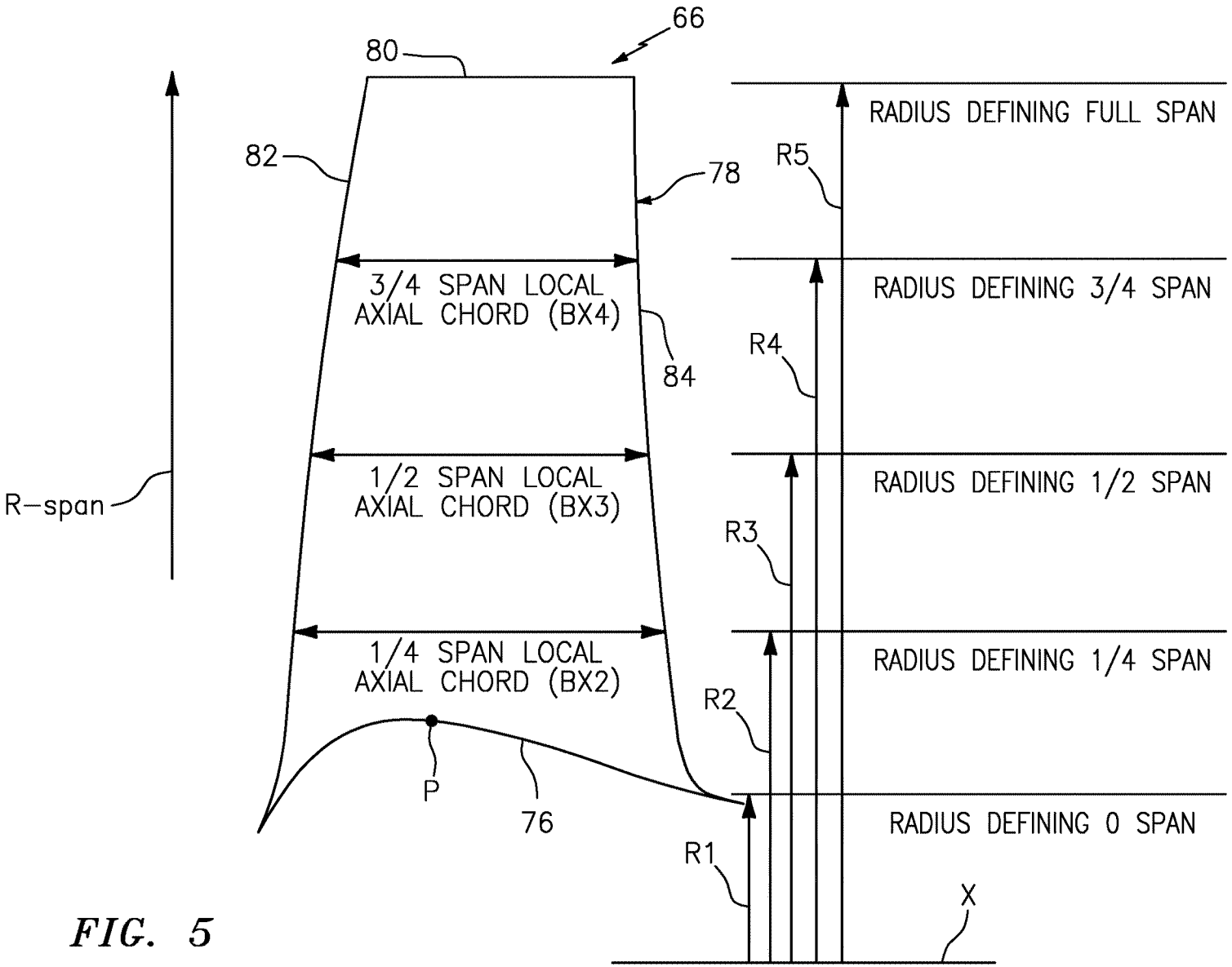
FIG. 5 illustrates the span positions and local axial chords referenced in Table 1.

Referring to FIG. 5, the geometries of external surfaces of airfoil 78 are described in terms of Cartesian coordinates defined along x, y, and z axes, which respectively correspond to the axial (x), circumferential (y), and radial (R-span) (z) directions shown in FIGS. 3A and 3B. The span coordinate is provided as a radial distance (R1-R5) from the rotational axis X of the airfoil 78. The "0" span is taken at a point P where the airfoil 78 meets the platform 76, as schematically illustrated in FIG. 4. The overall or full span is 100% the distance from the point P to the tip 80 in the radial direction R-span. By way of example, the "¼ span" is 25% the distance from the point P toward the tip 80 in the radial direction R-span. In one example, R3, or the mean radius, is 8.67 inches (22.0 cm) where the span ranges from 7.63 to 9.71 inches (19.4 to 24.7 cm).

The axial (x) and circumferential (y) coordinates are normalized by the local axial chord (Bx) for the given span location (Bx1-Bx4). By way of example, local axial chord (Bx2) for axial (x) and circumferential (y) coordinates associated with the ¼ span corresponds to the width of the airfoil 78 between the leading and trailing edges 82, 84 at the ¼ span location.

The contour of the airfoil 78 is set forth in Table 1, which provides the axial (x) and circumferential (y) coordinates (in inches) for given span locations or positions. Three-dimensional airfoil surfaces are formed by joining adjacent points in Table 1 in a smooth manner and joining adjacent sections or sectional profiles along the span. The manufacturing tolerance relative to the specified coordinates is ±0.010 inches (±0.254 mm). In other embodiments, the manufacturing tolerance relative to the specified coordinates is ±0.030 inches (±0.762 mm). The coordinates define points on a cold, uncoated, stationary airfoil surface, in a plane at the corresponding span positions. Additional elements such as cooling holes, protective coatings, fillets, and seal structures may also be formed onto the specified airfoil surface, or onto an adjacent platform surface, but these elements are not necessarily described by the normalized coordinates. For example, a variable coating may be applied between 0.0001 inches (0.003 mm) (trace) and 0.01 inches (0.28 mm) thick.

TABLE 1

| REFERENCE RADIUS: R1 SECTION COORDINATES (X, Y)/BX1 | |
|---|---|
| 0.000 | −0.005 |
| −0.001 | −0.004 |
| −0.001 | −0.002 |
| −0.003 | 0.000 |
| −0.004 | 0.003 |
| −0.006 | 0.008 |
| −0.007 | 0.014 |
| −0.009 | 0.022 |
| −0.010 | 0.033 |
| −0.010 | 0.048 |
| −0.007 | 0.065 |
| −0.002 | 0.085 |
| 0.007 | 0.108 |
| 0.020 | 0.132 |
| 0.037 | 0.157 |
| 0.057 | 0.184 |
| 0.081 | 0.212 |
| 0.110 | 0.240 |
| 0.143 | 0.265 |
| 0.181 | 0.287 |
| 0.225 | 0.304 |
| 0.270 | 0.313 |
| 0.317 | 0.314 |
| 0.364 | 0.307 |
| 0.410 | 0.294 |
| 0.453 | 0.276 |
| 0.495 | 0.253 |
| 0.534 | 0.226 |
| 0.571 | 0.196 |
| 0.606 | 0.165 |
| 0.639 | 0.131 |
| 0.670 | 0.096 |
| 0.700 | 0.059 |
| 0.729 | 0.021 |
| 0.756 | −0.017 |
| 0.783 | −0.056 |
| 0.808 | −0.095 |
| 0.831 | −0.134 |
| 0.854 | −0.172 |
| 0.873 | −0.208 |
| 0.892 | −0.243 |
| 0.909 | −0.275 |
| 0.923 | −0.305 |
| 0.936 | −0.332 |

TABLE 1-continued

| | |
|---|---|
| 0.948 | −0.356 |
| 0.958 | −0.378 |
| 0.966 | −0.397 |
| 0.973 | −0.413 |
| 0.979 | −0.426 |
| 0.983 | −0.436 |
| 0.986 | −0.443 |
| 0.989 | −0.449 |
| 0.990 | −0.454 |
| 0.989 | −0.457 |
| 0.988 | −0.460 |
| 0.987 | −0.461 |
| 0.986 | −0.462 |
| 0.985 | −0.463 |
| 0.984 | −0.463 |
| 0.982 | −0.464 |
| 0.980 | −0.464 |
| 0.976 | −0.464 |
| 0.972 | −0.462 |
| 0.968 | −0.459 |
| 0.962 | −0.453 |
| 0.956 | −0.445 |
| 0.947 | −0.436 |
| 0.937 | −0.425 |
| 0.925 | −0.413 |
| 0.912 | −0.399 |
| 0.897 | −0.383 |
| 0.881 | −0.366 |
| 0.863 | −0.347 |
| 0.843 | −0.327 |
| 0.822 | −0.306 |
| 0.798 | −0.284 |
| 0.774 | −0.263 |
| 0.748 | −0.242 |
| 0.721 | −0.221 |
| 0.693 | −0.202 |
| 0.664 | −0.183 |
| 0.635 | −0.166 |
| 0.605 | −0.151 |
| 0.574 | −0.137 |
| 0.542 | −0.124 |
| 0.510 | −0.114 |
| 0.477 | −0.104 |
| 0.444 | −0.096 |
| 0.410 | −0.090 |
| 0.377 | −0.084 |
| 0.343 | −0.079 |
| 0.309 | −0.076 |
| 0.277 | −0.072 |
| 0.244 | −0.070 |
| 0.212 | −0.068 |
| 0.183 | −0.066 |
| 0.154 | −0.065 |
| 0.128 | −0.064 |
| 0.105 | −0.063 |
| 0.083 | −0.059 |
| 0.065 | −0.054 |
| 0.049 | −0.048 |
| 0.036 | −0.042 |
| 0.025 | −0.035 |
| 0.017 | −0.028 |
| 0.012 | −0.022 |
| 0.008 | −0.018 |
| 0.005 | −0.014 |
| 0.003 | −0.011 |
| 0.002 | −0.009 |
| 0.001 | −0.007 |
| 0.001 | −0.006 |
| REFERENCE RADIUS: R2 | |
| SECTION COORDINATES (X, Y)/BX2 | |
| 0.000 | 0.160 |
| 0.000 | 0.161 |
| 0.000 | 0.163 |
| −0.001 | 0.166 |
| −0.001 | 0.169 |
| −0.001 | 0.174 |
| −0.001 | 0.181 |
| 0.000 | 0.189 |
| 0.002 | 0.200 |

TABLE 1-continued

| | |
|---|---|
| 0.007 | 0.214 |
| 0.014 | 0.230 |
| 0.026 | 0.248 |
| 0.042 | 0.266 |
| 0.061 | 0.286 |
| 0.085 | 0.306 |
| 0.113 | 0.326 |
| 0.145 | 0.343 |
| 0.184 | 0.357 |
| 0.225 | 0.364 |
| 0.271 | 0.364 |
| 0.317 | 0.357 |
| 0.362 | 0.345 |
| 0.408 | 0.328 |
| 0.451 | 0.307 |
| 0.492 | 0.281 |
| 0.531 | 0.252 |
| 0.567 | 0.220 |
| 0.601 | 0.185 |
| 0.632 | 0.148 |
| 0.662 | 0.110 |
| 0.691 | 0.071 |
| 0.717 | 0.030 |
| 0.743 | −0.011 |
| 0.767 | −0.053 |
| 0.790 | −0.096 |
| 0.812 | −0.139 |
| 0.834 | −0.180 |
| 0.855 | −0.222 |
| 0.875 | −0.263 |
| 0.893 | −0.301 |
| 0.909 | −0.338 |
| 0.924 | −0.372 |
| 0.937 | −0.404 |
| 0.949 | −0.432 |
| 0.959 | −0.458 |
| 0.968 | −0.480 |
| 0.976 | −0.500 |
| 0.983 | −0.516 |
| 0.989 | −0.530 |
| 0.993 | −0.540 |
| 0.996 | −0.548 |
| 0.999 | −0.554 |
| 0.999 | −0.558 |
| 0.998 | −0.562 |
| 0.996 | −0.564 |
| 0.995 | −0.566 |
| 0.994 | −0.567 |
| 0.993 | −0.567 |
| 0.992 | −0.568 |
| 0.989 | −0.568 |
| 0.987 | −0.569 |
| 0.983 | −0.568 |
| 0.978 | −0.566 |
| 0.974 | −0.562 |
| 0.969 | −0.554 |
| 0.962 | −0.545 |
| 0.953 | −0.534 |
| 0.943 | −0.521 |
| 0.932 | −0.505 |
| 0.919 | −0.488 |
| 0.904 | −0.469 |
| 0.887 | −0.448 |
| 0.869 | −0.425 |
| 0.849 | −0.400 |
| 0.828 | −0.375 |
| 0.805 | −0.348 |
| 0.780 | −0.320 |
| 0.754 | −0.294 |
| 0.727 | −0.267 |
| 0.699 | −0.241 |
| 0.670 | −0.215 |
| 0.641 | −0.191 |
| 0.611 | −0.167 |
| 0.581 | −0.144 |
| 0.549 | −0.122 |
| 0.517 | −0.102 |
| 0.484 | −0.082 |
| 0.450 | −0.064 |
| 0.416 | −0.048 |

TABLE 1-continued

| | |
|---|---|
| 0.381 | −0.033 |
| 0.345 | −0.020 |
| 0.308 | −0.008 |
| 0.273 | 0.001 |
| 0.237 | 0.011 |
| 0.203 | 0.020 |
| 0.171 | 0.029 |
| 0.141 | 0.039 |
| 0.113 | 0.049 |
| 0.088 | 0.059 |
| 0.067 | 0.071 |
| 0.050 | 0.083 |
| 0.035 | 0.096 |
| 0.024 | 0.108 |
| 0.016 | 0.119 |
| 0.010 | 0.129 |
| 0.006 | 0.137 |
| 0.004 | 0.143 |
| 0.002 | 0.148 |
| 0.001 | 0.152 |
| 0.001 | 0.155 |
| 0.000 | 0.157 |
| 0.000 | 0.158 |
| REFERENCE RADIUS: R3 | |
| SECTION COORDINATES (X, Y)/BX3 | |
| 0.000 | 0.253 |
| 0.000 | 0.255 |
| −0.001 | 0.256 |
| −0.002 | 0.260 |
| −0.003 | 0.263 |
| −0.003 | 0.268 |
| −0.004 | 0.274 |
| −0.005 | 0.283 |
| −0.005 | 0.295 |
| −0.003 | 0.310 |
| 0.001 | 0.327 |
| 0.009 | 0.348 |
| 0.021 | 0.370 |
| 0.037 | 0.393 |
| 0.060 | 0.415 |
| 0.092 | 0.431 |
| 0.129 | 0.438 |
| 0.171 | 0.436 |
| 0.213 | 0.427 |
| 0.257 | 0.412 |
| 0.301 | 0.391 |
| 0.342 | 0.366 |
| 0.382 | 0.336 |
| 0.420 | 0.303 |
| 0.455 | 0.268 |
| 0.489 | 0.231 |
| 0.520 | 0.193 |
| 0.551 | 0.153 |
| 0.581 | 0.113 |
| 0.610 | 0.073 |
| 0.638 | 0.032 |
| 0.666 | −0.010 |
| 0.694 | −0.052 |
| 0.720 | −0.094 |
| 0.746 | −0.137 |
| 0.772 | −0.180 |
| 0.796 | −0.221 |
| 0.820 | −0.263 |
| 0.843 | −0.304 |
| 0.865 | −0.342 |
| 0.885 | −0.379 |
| 0.903 | −0.413 |
| 0.920 | −0.444 |
| 0.934 | −0.472 |
| 0.947 | −0.497 |
| 0.959 | −0.520 |
| 0.969 | −0.539 |
| 0.977 | −0.555 |
| 0.984 | −0.569 |
| 0.989 | −0.580 |
| 0.992 | −0.587 |
| 0.995 | −0.593 |
| 0.995 | −0.598 |
| 0.994 | −0.602 |

TABLE 1-continued

| | |
|---|---|
| 0.993 | −0.605 |
| 0.992 | −0.606 |
| 0.990 | −0.607 |
| 0.989 | −0.608 |
| 0.988 | −0.608 |
| 0.986 | −0.609 |
| 0.983 | −0.610 |
| 0.979 | −0.610 |
| 0.974 | −0.608 |
| 0.968 | −0.604 |
| 0.963 | −0.597 |
| 0.955 | −0.587 |
| 0.946 | −0.576 |
| 0.935 | −0.562 |
| 0.923 | −0.546 |
| 0.908 | −0.529 |
| 0.892 | −0.509 |
| 0.875 | −0.487 |
| 0.856 | −0.463 |
| 0.835 | −0.437 |
| 0.813 | −0.410 |
| 0.789 | −0.381 |
| 0.764 | −0.351 |
| 0.738 | −0.323 |
| 0.710 | −0.293 |
| 0.683 | −0.264 |
| 0.655 | −0.235 |
| 0.626 | −0.207 |
| 0.598 | −0.179 |
| 0.569 | −0.151 |
| 0.539 | −0.124 |
| 0.509 | −0.098 |
| 0.479 | −0.072 |
| 0.448 | −0.046 |
| 0.417 | −0.021 |
| 0.385 | 0.003 |
| 0.352 | 0.026 |
| 0.319 | 0.049 |
| 0.286 | 0.070 |
| 0.253 | 0.090 |
| 0.221 | 0.108 |
| 0.190 | 0.124 |
| 0.160 | 0.138 |
| 0.132 | 0.150 |
| 0.105 | 0.161 |
| 0.082 | 0.170 |
| 0.062 | 0.181 |
| 0.045 | 0.192 |
| 0.032 | 0.203 |
| 0.022 | 0.214 |
| 0.015 | 0.223 |
| 0.010 | 0.231 |
| 0.007 | 0.237 |
| 0.004 | 0.242 |
| 0.003 | 0.246 |
| 0.002 | 0.248 |
| 0.001 | 0.251 |
| 0.000 | 0.252 |
| REFERENCE RADIUS: R4 | |
| SECTION COORDINATES (X, Y)/BX4 | |
| 0.000 | 0.475 |
| 0.000 | 0.477 |
| 0.000 | 0.478 |
| 0.001 | 0.482 |
| 0.001 | 0.485 |
| 0.002 | 0.491 |
| 0.004 | 0.497 |
| 0.007 | 0.506 |
| 0.012 | 0.517 |
| 0.019 | 0.531 |
| 0.031 | 0.546 |
| 0.047 | 0.562 |
| 0.071 | 0.574 |
| 0.100 | 0.578 |
| 0.133 | 0.575 |
| 0.168 | 0.565 |
| 0.205 | 0.550 |
| 0.243 | 0.528 |
| 0.279 | 0.501 |

TABLE 1-continued

| | |
|---|---|
| 0.314 | 0.467 |
| 0.348 | 0.430 |
| 0.379 | 0.390 |
| 0.409 | 0.347 |
| 0.439 | 0.304 |
| 0.468 | 0.261 |
| 0.497 | 0.218 |
| 0.525 | 0.174 |
| 0.553 | 0.129 |
| 0.580 | 0.085 |
| 0.607 | 0.040 |
| 0.634 | −0.005 |
| 0.661 | −0.050 |
| 0.687 | −0.095 |
| 0.713 | −0.140 |
| 0.739 | −0.186 |
| 0.765 | −0.231 |
| 0.790 | −0.275 |
| 0.815 | −0.319 |
| 0.839 | −0.362 |
| 0.861 | −0.401 |
| 0.882 | −0.440 |
| 0.901 | −0.475 |
| 0.919 | −0.507 |
| 0.935 | −0.536 |
| 0.949 | −0.563 |
| 0.961 | −0.586 |
| 0.972 | −0.606 |
| 0.981 | −0.623 |
| 0.988 | −0.637 |
| 0.994 | −0.647 |
| 0.998 | −0.655 |
| 1.000 | −0.662 |
| 0.999 | −0.667 |
| 0.998 | −0.671 |
| 0.997 | −0.674 |
| 0.996 | −0.675 |
| 0.995 | −0.677 |
| 0.993 | −0.677 |
| 0.992 | −0.678 |
| 0.989 | −0.679 |
| 0.986 | −0.680 |
| 0.981 | −0.680 |
| 0.975 | −0.678 |
| 0.969 | −0.674 |
| 0.962 | −0.665 |
| 0.954 | −0.654 |
| 0.943 | −0.641 |
| 0.931 | −0.625 |
| 0.917 | −0.606 |
| 0.901 | −0.585 |
| 0.883 | −0.562 |
| 0.864 | −0.535 |
| 0.844 | −0.506 |
| 0.821 | −0.475 |
| 0.798 | −0.442 |
| 0.772 | −0.407 |
| 0.745 | −0.371 |
| 0.718 | −0.336 |
| 0.689 | −0.299 |
| 0.660 | −0.263 |
| 0.631 | −0.227 |
| 0.601 | −0.191 |
| 0.571 | −0.156 |
| 0.541 | −0.121 |
| 0.510 | −0.086 |
| 0.478 | −0.052 |
| 0.446 | −0.018 |
| 0.413 | 0.014 |
| 0.380 | 0.046 |
| 0.345 | 0.077 |
| 0.310 | 0.107 |
| 0.273 | 0.136 |
| 0.238 | 0.163 |
| 0.204 | 0.192 |
| 0.171 | 0.220 |
| 0.141 | 0.247 |
| 0.114 | 0.275 |
| 0.090 | 0.301 |
| 0.069 | 0.326 |

TABLE 1-continued

| | |
|---|---|
| 0.051 | 0.349 |
| 0.036 | 0.370 |
| 0.023 | 0.389 |
| 0.013 | 0.407 |
| 0.007 | 0.423 |
| 0.003 | 0.436 |
| 0.001 | 0.447 |
| 0.000 | 0.455 |
| 0.000 | 0.461 |
| 0.000 | 0.466 |
| 0.000 | 0.469 |
| 0.000 | 0.472 |
| 0.000 | 0.473 |

In general, the turbine blade airfoil 78, as described herein, has a combination of axial sweep and tangential lean. Depending on configuration, the lean and sweep angles sometimes vary by up to ±10° or more. In addition, the turbine blade 78 is sometimes rotated with respect to a radial axis or a normal to the platform or shroud surface, for example, by up to ±10° or more.

Novel aspects of the turbine blade and associated airfoil surfaces described herein are achieved by substantial conformance to specified geometries. Substantial conformance generally includes or may include a manufacturing tolerance of about ±0.05 inches (±1.27 mm), in order to account for variations in molding, cutting, shaping, surface finishing and other manufacturing processes, and to accommodate variability in coating thicknesses. This tolerance is generally constant or not scalable, and applies to each of the specified blade surfaces, regardless of size.

Substantial conformance is based on sets of points representing a three-dimensional surface with particular physical dimensions, for example, in inches or millimeters, as determined by selecting particular values of the scaling parameters. A substantially conforming airfoil, blade or, or vane structure has surfaces that conform to the specified sets of points, within the specified tolerance.

Alternatively, substantial conformance is based on a determination by a national or international regulatory body, for example, in a part certification or part manufacture approval (PMA) process for the Federal Aviation Administration, the European Aviation Safety Agency, the Civil Aviation Administration of China, the Japan Civil Aviation Bureau, or the Russian Federal Agency for Air Transport. In these configurations, substantial conformance encompasses a determination that a particular part or structure is identical to, or sufficiently similar to, the specified airfoil, blade, or vane, or that the part or structure complies with airworthiness standards applicable to the specified blade, vane, or airfoil. In particular, substantial conformance encompasses any regulatory determination that a particular part or structure is sufficiently similar to, identical to, or the same as a specified blade, vane, or airfoil, such that certification or authorization for use is based at least in part on the determination of similarity.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A turbine blade for a gas turbine engine comprising:

an airfoil including leading and trailing edges joined by spaced-apart pressure and suction sides to provide an exterior airfoil surface extending from a platform in a radial direction to a tip; wherein the external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by the local axial chord, and a span location, wherein the local axial chord corresponds to a width of the airfoil between the leading edge and trailing edges at the span location; and wherein the Cartesian coordinates in Table 1 have a tolerance relative to the specified coordinates of ±0.050 inches (1.27 mm).

2. The turbine blade of claim 1, wherein the airfoil is a second-stage turbine blade.

3. The turbine blade of claim 1, wherein the span location corresponds to a distance from a rotational axis of the airfoil.

4. A gas turbine engine comprising:

a high-pressure turbine configured to drive a compressor section;

wherein the high-pressure turbine comprises an array of turbine blades, wherein at least one turbine blade comprises an airfoil having leading and trailing edges joined by spaced-apart pressure and suction sides to provide an exterior airfoil surface extending from a platform in a radial direction to a tip; wherein the external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by the local axial chord, and a span location, wherein the local axial chord corresponds to a width of the airfoil between the leading edge and trailing edges at the span location; and wherein the Cartesian coordinates in Table 1 have a tolerance relative to the specified coordinates of ±0.050 inches (1.27 mm).

5. The gas turbine engine of claim 4, wherein the array is a second-stage array of turbine blades.

6. The gas turbine engine of claim 5, wherein the high-pressure turbine comprises an array of fixed stator vanes upstream from the second-stage array of turbine blades.

7. The gas turbine engine of claim 5, wherein the second-stage array of turbine blades includes forty-four turbine blades.

8. The gas turbine engine of claim 4, wherein the span location corresponds to a distance from a rotational axis of the airfoil.

9. The gas turbine engine of claim 4, wherein the high-pressure turbine includes two arrays of turbine blades and two arrays of fixed stator vanes.

10. A gas turbine engine comprising:

a compressor section;

a combustor in fluid communication with the compressor section; and a turbine section in fluid communication with the combustor, the turbine section comprising a high-pressure turbine coupled to the compressor section via a shaft and a low-pressure turbine aft of the high-pressure turbine;

wherein the high-pressure turbine includes an array of turbine blades, wherein at least one turbine blade includes an airfoil having leading and trailing edges joined by spaced-apart pressure and suction sides to provide an exterior airfoil surface extending from a platform in a radial direction to a tip; wherein the external airfoil surface is formed in substantial conformance with multiple cross-sectional profiles of the airfoil described by a set of Cartesian coordinates set forth in Table 1, the Cartesian coordinates provided by an axial coordinate scaled by a local axial chord, a circumferential coordinate scaled by the local axial chord, and a span location, wherein the local axial chord corresponds to a width of the airfoil between the leading edge and trailing edges at the span location; and wherein the Cartesian coordinates in Table 1 have a tolerance relative to the specified coordinates of ±0.050 inches (1.27 mm).

11. The gas turbine engine of claim 10, wherein the array is a second-stage array of turbine blades.

12. The gas turbine engine of claim 11, wherein the high-pressure turbine includes an array of fixed stator vanes upstream from the second-stage array of turbine blades.

13. The gas turbine engine of claim 11, wherein the second-stage array of turbine blades includes forty-four turbine blades.

14. The gas turbine engine of claim 10, wherein the span location corresponds to a distance from a rotational axis of the airfoil.

15. The gas turbine engine of claim 10, wherein the high-pressure turbine includes two arrays of turbine blades and two arrays of fixed stator vanes.

16. The gas turbine engine of claim 10, wherein the low-pressure turbine includes between three and six stages of turbine blades.

17. The gas turbine engine of claim 10, further comprising:

a fan section including a plurality of fan blades; and a geared architecture configured to cause the fan section to rotate at a lower speed than the low-pressure turbine.

* * * * *